US008875341B2

(12) United States Patent
Gooden et al.

(10) Patent No.: US 8,875,341 B2
(45) Date of Patent: Nov. 4, 2014

(54) CLEANING DEVICE

(76) Inventors: Luke Gooden, Hemet, CA (US); Janice Gooden, Hemet, CA (US)

( * ) Notice: Subject to any disclaimer, the term of this patent is extended or adjusted under 35 U.S.C. 154(b) by 294 days.

(21) Appl. No.: 13/304,218

(22) Filed: Nov. 23, 2011

(65) Prior Publication Data

US 2012/0124771 A1 May 24, 2012

Related U.S. Application Data

(60) Provisional application No. 61/458,438, filed on Nov. 23, 2010.

(51) Int. Cl.

| | |
|---|---|
| ***A47L 5/24*** | (2006.01) |
| ***A47L 7/00*** | (2006.01) |
| ***A47L 13/38*** | (2006.01) |
| ***A47L 9/28*** | (2006.01) |
| ***A47L 9/04*** | (2006.01) |
| ***A47L 5/26*** | (2006.01) |

(52) U.S. Cl.

CPC . *A47L 5/26* (2013.01); *A47L 13/38* (2013.01); *A47L 9/2884* (2013.01); *A47L 9/0416* (2013.01); *A47L 9/04* (2013.01)

USPC ..... 15/344; 15/327.5; 15/396

(58) Field of Classification Search

USPC ..... 15/344, 327.5, 419, 415.1, 393, 15/396–400, 421, 106, 114, 22.1, 23, 24, 15/29; 134/6, 21, 42, 902

See application file for complete search history.

(56) References Cited

U.S. PATENT DOCUMENTS

| | | | | |
|---|---|---|---|---|
| 5,050,266 | A * | 9/1991 | Schneider | 15/421 |
| 6,799,350 | B1 * | 10/2004 | Gordon | 15/344 |
| 7,437,797 | B2 * | 10/2008 | Ptak et al. | 15/398 |
| 7,465,359 | B2 * | 12/2008 | Vives-Martinez | 134/21 |
| 7,845,048 | B1 * | 12/2010 | Bailey et al. | 15/405 |
| 8,387,208 | B2 * | 3/2013 | Davis | 15/415.1 |

* cited by examiner

*Primary Examiner* — Dung Van Nguyen
(74) *Attorney, Agent, or Firm* — Donn K. Harms

(57) ABSTRACT

A cleaning device having a handheld housing engageable to one or both of a portable vacuum motor or the distal end of a hose for a conventional vacuum cleaner. The cleaning device employs a dusting head engageable to an extension that may be change to increase or decrease length to allow a user the position the dusting head further or closer to the housing to reach different areas in need of cleaning.

20 Claims, 2 Drawing Sheets

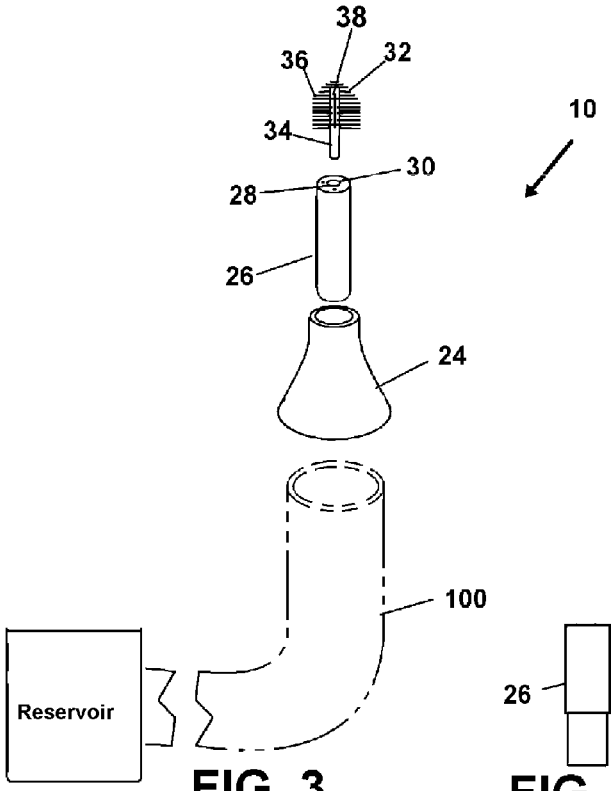
FIG. 3
FIG. 3a
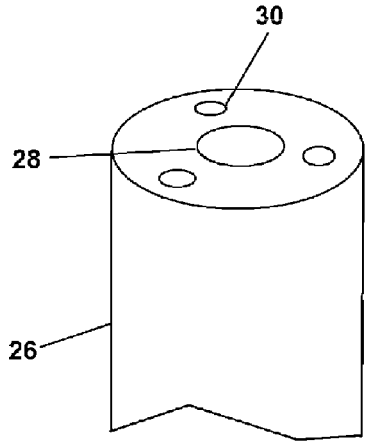
FIG. 4
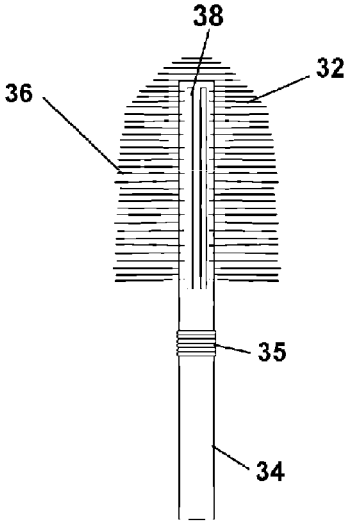
FIG. 5
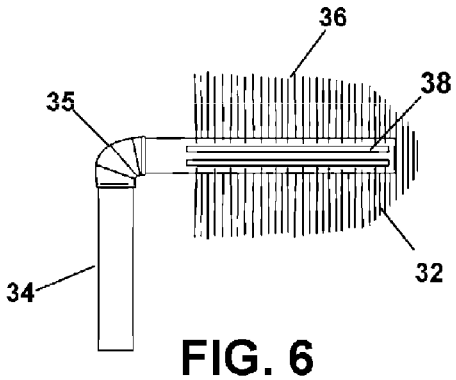
FIG. 6

CLEANING DEVICE

This application claims priority to U.S. Provisional Application Ser. No. 61/458,438 filed on Nov. 23, 2010, and is incorporated herein in its entirety by this reference thereto.

BACKGROUND OF THE INVENTION

1. Field of the Invention

The present invention relates generally to a cleaning device. More particularly, the invention relates to a cleaning device consisting of a handheld, combination vacuum cleaner and duster designed to effectively remove dust from a wide variety of surfaces.

2. Prior Art

Cleaning devices have been the center of innovation for many years in order to provide a user with means for quick and effective cleaning. Typical household cleaning chores include vacuuming, wiping counter tops and dusting. Vacuum cleaning devices are a technology that continues to advance and provide improved means for removing dirt and debris from carpets and floors. Further, the plurality of cleaning solutions available to the average consumer also provide a user with means to clean and disinfect almost every surface in a house. However, many conventional dusting devices fall short in providing convenient cleaning means in that the devices merely move or spread dust around rather then remove it completely.

Conventionally, dusting involves the employment of a dusting device, such as feather duster, intended for removing dust from surfaces and between tight spaces. However, as mentioned, as a user passes the dusting device over a surface or area containing dust, the dust particles are simply moved around or disturbed and released into the air, only to settle back onto a surface moments later. As such, dust continues to remain in the home where it can cause health issues, contain dust mites, and clog and potentially harm electronic devices.

As a solution, manufacturers have begun to produce statically attractive dusting devices made from synthetic materials. With these devices, as they pass over a surface containing dust, the dust particles are statically attracted to the device and essentially stick to the material and the dust is removed from the surface. However, these and similar devices fall short in that now the devices themselves must be cleaned and removed of the dust which can be difficult due to the statically attractive nature of the material itself. Further, these devices are limited in the quantity of dust that can be removed due to the limited amount of synthetic material employed on the device.

Still further, many users may attempt to employ a conventional vacuum cleaner for dusting purposes. However, many vacuum cleaners are very bulky and/or do not provide adequate adapters for effectively removing dust from surfaces. Therefore, hard to reach areas such as high places and between small spaces continue to go uncleaned.

As such, there is a continuing unmet need for a cleaning device which provides a means to completely and effectively remove dust.

SUMMARY OF THE INVENTION

The device herein disclosed and described provides a solution to the shortcomings in prior art and achieves the above noted goals through the provision of a cleaning device consisting of a handheld unit, employing a combination vacuum means and duster designed to effectively remove dust from a wide variety of surfaces. In all modes of the device discussed below, there is included a plurality of special-purpose nozzle configurations and brush-styles intended to make dusting easy and far more effective.

In a first preferred mode, the cleaning device is comprised of a self-contained, battery-powered unit having a vacuum source powered by an onboard motor and pump, and duster head intended for use as a standalone, handheld, rechargeable vacuum-utility cleaner. In use, the device is preferably rechargeable with a standard 120-volt household outlet or it can easily be configured for power by an automotive power outlet also known as a cigarette lighter. However, the device may be powered by any means known in the art or as would occur to one skilled in the art.

In another particularly preferred mode, the device is employable as an attachment for an existing vacuum cleaner having a series of terminal attachments for engagement to a vacuum cleaner hose. Alternatively and preferred, due to increased utility, the self-powered mode of the device can employ a component adapted to engage both a vacuum hose, or its own onboard vacuum motor.

In all modes of the invention, the cleaning device is intended to collect the dust via the vacuum means rather than moving or spreading it around. The cleaning device includes a plurality of brush/vacuum heads, each of which consists of a hollow tube or nozzle that is engageable into a mounting collar of the device. The means for engagement can be a frictional engagement between the parts, or using projections on one part with depressions on the other, a snap fit may be employed. However, any other means known in the art, employable for the intended purpose of the invention herein, is also considered within the scope of this application.

The mounting collar provides a first connection for reducing the vacuum opening diameter which provides a means to speed up the airflow at the point of the reduction, wherein the additional components can be engaged for sealed fluid communication to a distal nozzle end. For example, and without limiting the device in any manner, the vacuum opening at the collar may reduce from ½ inch to ¼ inch, and further to a nozzle diameter of 1/32 inch. Each reduction will tend to increase airspeed fluid flow through the aperture formed which, when brushing small components and the like, can be used to pull dust and debris off delicate components more effectively.

Each of the various brush/vacuum heads are preferably tapered tubes and are offered in various lengths and configurations. As a further example, again not intended to limit the device in any manner, the device may consist of a 6-inch head, a 4-inch head, a stiff head, or a flexible head, and so forth. The nozzle ends are preferably fringed or ringed with dusting means such as feathers, soft bristles, micro fiber cloth, or other material suitable for the intended application. Additionally and preferred, the underlying tubes or nozzles having engaged dusting means thereon, employ slits, slots or apertures, through which the vacuum will function to pull air and the dust terminus of the nozzle. The apertures may be substantially small apertures to exercise further suction.

In the self-contained mode of the device, the vacuum portion is contained within a preferably cylindrical housing and employs the mounting collar as a means to engage the dusting head components. As such, the plurality of vacuum/brush heads are essentially identical in terms of their terminal diameters, providing a universal engagement means to engage the collar and the vacuum portion of the device. In use, the dust will be drawn into the housing, which itself can be easily disconnected for emptying.

In the mode of the device intended for engagement to existing vacuum cleaners, there is included a series of reducing diameter connectors, as well as an extension hose, enabling the user to connect the substantially small diameter terminal fittings of the cleaning device heads to the much larger standard, home or shop vacuum cleaner hose. In use, the dust is drawn in via the vacuum force provided by the conventional vacuum cleaner.

The components of the device are preferably formed of a tough and durable, injection-molded thermoplastic, and the device can be offered in a variety of colors and finishes.

BRIEF DESCRIPTION OF THE DRAWINGS

FIG. 3 shows a view of yet another mode of the device intended for engagement to an existing vacuum hose.

FIG. 3*a* depicts a telescopic mode of the extension which may have two or more sections to allow for elongation.

FIG. 4 shows a detailed view of the distal end of an intermediate tube which communicates between the mounting collar and head of the device.

FIG. 5 shows a side view of a preferred mode of the head component of the device having a plurality of slots or apertures formed thereon and bristles extending therefrom, the head also having an articulating portions, such as a living hinge, to allow the head to bend as needed.

FIG. 6 shows the preferred mode of the head component of FIG. 5 in an as used position.

DETAILED DESCRIPTION OF THE PREFERRED EMBODIMENTS

Figure 1:
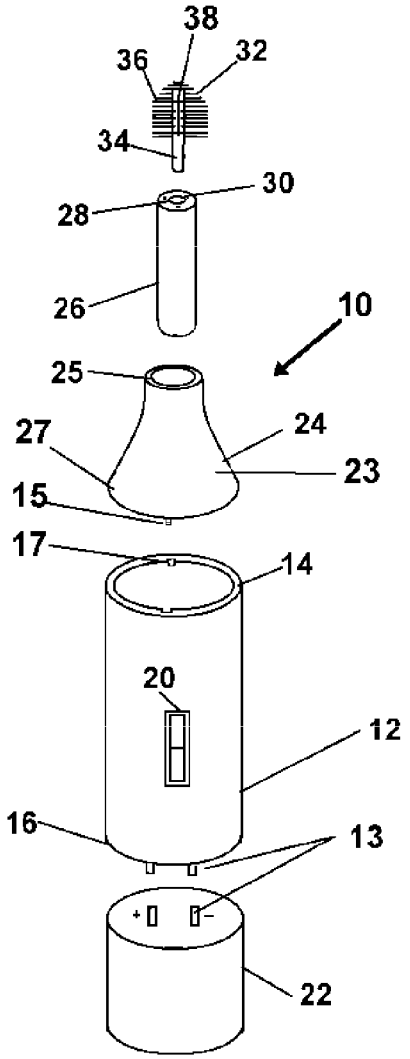
FIG. 1 shows a perspective exploded view of a preferred self contained mode of the device.

Now referring to drawings in FIGS. 1-6, wherein similar components are identified by like reference numerals, there is seen in FIG. 1 an exploded view of one particularly preferred self-contained mode of the cleaning device 10. As shown, the device 10 includes a housing 12 for internally housing a battery powered vacuum source (not shown), such as an electric vacuum pump. The housing 12 has an aperture formed at an open first end 14 which communicates in a sealed engagement with the vacuum pump engaged within the housing 12 to provide a fluid conduit thereto when the pump is energized. The second end 16 is configured for a removable engagement with the battery pack 22 and electrical communication with a power source 22 such as the rechargeable battery pack 22 through the employment of conductive cooperative contacts 13. The contacts 13 shown as pin and recess can also provide means for engagement of the battery pack 22 to the housing 12 with a sufficient frictional engagement of the contacts 13.

However, other means for engagement of the housing 12 to the battery pack 22 may be employed such as projecting pins 15 engaging depressions 17 formed on the two components or a frictional engagement of the interior of the second end 16 with the circumference of the battery pack 22. Additionally shown is an on/off switch 20 which may be positioned on the battery pack 22 or the housing 12 and which is wired to close or open an electrical circuit to communicate electrical power to the motor in the housing 12.

On the opposite or second end 25 of the housing 12 there is shown the brush housing 23 having a mounting collar 24 preferably of a frustoconcial shape widening toward an engagement end 27. The mounting collar 24 is engaged to the open first end 14 of the housing 12 by means of removable engagement, including but not limited to any from a group including cooperative snap locks 15 engaging depressions 17, a frictional engagement of the engagement end 27 with the first end 14, any conventional vacuum cleaner hose 100 to attachment connection, or other means for removable engagement as would occur to those in the art.

The collar 24 provides a means to transition the fluid flow drawn toward the engagement end 27 of the brush housing 23 to a smaller diameter opening 25. This decrease of diameter provides a means for increasing the velocity of the fluid flow through the opening 25 area and to the smaller conduit formed in line with the axis of the extension portion 26.

The fluid flow in the decreased sized axial conduit, flowing in the direction toward the engagement end 27 when a vacuum source is engaged to the brush housing 23, then may be communicated to the sides adjacent to any mounted head components on the distal end of the extension portion 26 of the device 10. Such an adjacent draw of air in a fluid stream may be imparted by one or preferably a plurality of extension apertures 28 and 30, which may be formed at the distal end of the extension portion 26 of the brush housing 23. Additionally, this intake of air in the fluid flow may also be communicated through the extension-engaged component itself, if such adapted to communicate with the elongated internal conduit of the extension portion 26.

While the brush housing 23 may be formed in a single unitary component of collar 24 and extension portion 26 configured to engage the head component 32, it is preferred that the extension portion 26 is engaged in a removable sealed engagement to the collar 24. Engagement of the extension portion 26, just like the brush housing 23 to a vacuum source, may be made by any means for removable sealed engagement and can be held by cooperating fasteners 15 and 17, fictional engagement of the extension portion 26 with the collar 24, or other means of engagement as would occur to those skilled in the art.

This preferred removable engagement of the extension portion 26 allows for engagement of a plurality of different length extension portions 26 which may be sold separately or provided with the device 10 in a kit. Also, the extension portion 26 may be formed to telescopically as in FIG. 3*a*, extend and contract between a shortest length and an elongated length. Allowing a removable engagement of the extension portion 26 as a means for varying its length, allows the user to engage the appropriate extension portion 26 to the task at hand. If the user needs to clean elevated and hard to reach places, a longer extension portion 26 may be engaged from the plurality available, or if it is telescopic, the extension portion may be elongated to reach the intended elevated target.

Still further, the extension portion 26 is configures at the distal end, to mount a head component 32. The head component 32 will have a central elongated member shown as tube portion 34 which at a first end, engages the distal end of the extension portion 26. At the distal end of the tube portion 34 and a central portion between the distal end and first end, are positioned means for dusting, such as a plurality of pliable members such as bristles 36 engaged thereon. It must be noted that the pliable members forming the dusting means may be of any material adapted to the task of softly contacting a surface to be cleaned, and while not limited by, may be formed of one or a plurality of materials from a group including polymeric material, feathers, microfiber, cloth, hair, nylon, polyethylene, polypropylene, bamboo, or other natural or synthetic material conventionally employed for dusting.

Figure 1B:
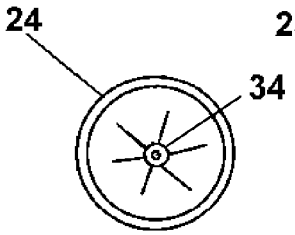
FIG. 1*b* depicts a mode of the brush housing wherein the brush may rotate using the movement of incoming air over blades.
Figure 2:
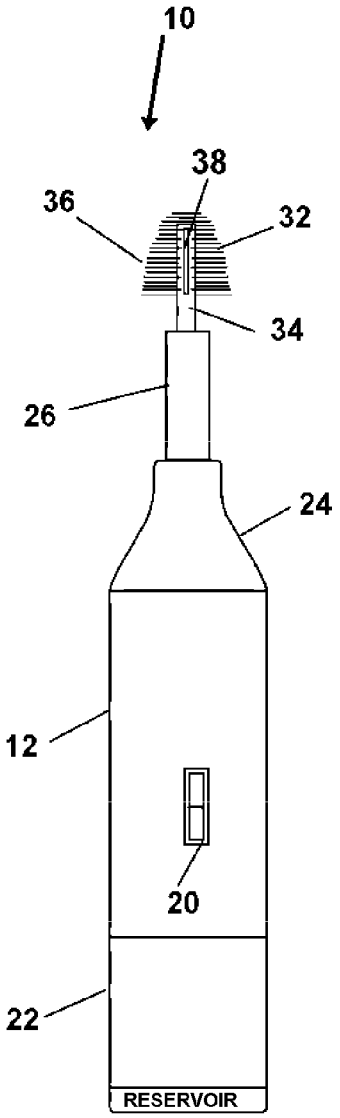
FIG. 2 shows a perspective view of the complete assembly of the device of FIG. 1.

The head component 32 may be permanently engaged but is preferably removably engageable to an engagement position at the distal end of the extension portion 26 and would appear as a complete assembly of the brush housing 23 of the device 10 in FIG. 2. A sealed fluid communication channel is achieved between the vacuum source, be it an engaged vacuum cleaner or the housing 12, and head component 32. If suction is desired to the base of the bristles 36 it max be communicated through an axial conduit in the bristle member or tube portion 34 in sealed communication with the conduit in the extension portion 26. Communication of the suction drawing in the fluid stream at the base of the bristles 36 may be provided by one or a plurality of formed tube apertures 38 such as the depicted slits or slots, or otherwise formed tube apertures 38 disposed at or near the engagement of the bristles 36 to the tube portion 34. The tube apertures 38 may be employed with or without the extension apertures 28 and 30, just as the extension apertures 28,30, may be employed with or without the tube apertures 38. If the tube portion 34 is engaged in a rotational engagement such as in FIG. 1*b*, employment solely of the extension apertures 28 and 30 may be more desirable depending on rotation speed, as the centrifugal force of the bristles on dust and dirt will tend to move it adjacent to the distal end of the bristles where an incoming fluid stream to the extension apertures 28 and 30 will capture it.

If the tube portion 34 employs apertures 38 in contact with its axial passage upon engaging a vacuum source be it the vacuum within the housing 12, or the distal end of a vacuum cleaner hose 100, dust will be drawn into the tube 34. It will then be drawn along with the fluid stream of air, through the extension portion 26 and collar 24, and ultimately to a means for dust collection either in the engaged vacuum cleaner or in the housing 12. If the brush housing 23 is employed with the vacuum housing 12, it can then be easily disengaged for emptying dust collected therein and for cleaning.

Figure 1A:
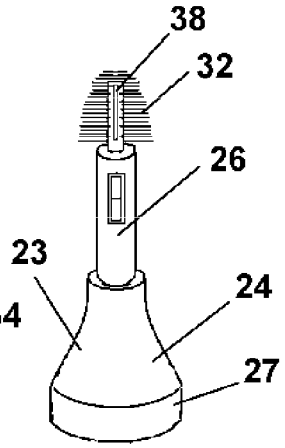
FIG. 1*a* depicts a mode of the device wherein the brush housing is adapted to fit both the battery powered vacuum component and the distal end of a vacuum hose such as for an electric vacuum cleaner.

FIG. 1*a* depicts a mode of the device 10 noted, wherein the brush housing 23 is provided with a housing circumference which matches that of the distal end of a hose 100 from a conventional vacuum cleaner, which is currently substantially 1.25 inches in widely sold electric vacuum cleaners from multiple manufacturers. The device 10 can be sold as just the brush housing 23 with the engageable extension portion 26 or more preferably would be provided with both the vacuum pump housing 12 having a circumference substantially 1.25 inches, and a brush housing 23 with an engagement end 27 configured with an internal circumference equal to, or slightly smaller than 1.25 inches. Preferably this engagement end 27 is formed of pliable or slightly elastic material which will form a sealed engagement with either the pump housing 12 or a vacuum cleaner hose 100.

In this fashion, the user will have the option to use the brush housing 23 with engaged extension portion 26 and brush with either the battery powered vacuum pump with the housing 12, or with their conventional vacuum cleaner by engagement to its hose 100.

Of course, the device 10 might also be sold in separate components of brush housing 23 with engaged or engageable extension portions 26 with head component 32, and housing 12, and allow the user to decide if they wish to have the utility of the battery operated housing 12 for smaller, hard to reach or delicate cleaning jobs, where lugging a large electric vacuum cleaner with high powered fluid stream would not be desirable.

As indicated FIG. 1*b* depicts a mode of the brush housing 23 wherein the head component 32 may rotate using the movement of the fluid stream, over rotationally engaged blades 33. Preferably this mode will employ the engagement end 27 of FIG. 1*a* so as to provide a chamber for the blades 33 to rotate and to provide a round inner circumference to the engagement end 27 which is sized to frictionally engage upon either the housing 12 or a vacuum cleaner hose 100 distal end. Rotation of the head component 32 is caused by rotation of the rotationally engaged tube component 34, or a shaft running between the tube component 34 and blades 33 by a communication of the force of the fluid stream upon the blades 33. If rotation is not desirable for a given task, the tube component 34 may be locked by a removably engageable brake 35 which may be slid or depressed to contact the tube component 34 or a communicating shaft between the tube component 34 and hub engaged blades 33 to prevent rotation. Release would allow rotation again.

FIG. 3 shows yet another particularly preferred mode of the device 10 intended for dual engagement to one or both of the housing 12 and an existing vacuum cleaner hose 100. As can be seen, the mounting collar 24, in this mode, provides a means for removable engagement of the extension portion 26 and head component 32 to the hose 100. The means for removably engagement may be snap fits, frictional engagement in the aforementioned fashion, or other means suitable for the intended application. As such it is to be noted that the collar 24 may require slight modification in order to properly engage to an existing hose 100 wherein such modifications are anticipated.

In all modes of the device 10 however, there is seen in FIG. 4 a detailed view of the extension portion 26. The plurality of formed axial passages include at least a central passage 28 and at least one extension aperture 30. As mentioned, the central passage 28 provides an engagement means for the tube portion 34 of the head 32 and additionally provides the sealed fluid communication channel between the apertures 38 of the head 32 and collar 24. The extension apertures 30 provide additional means for collecting dust. In use, due to the relatively close proximity of the extension apertures 30 to the bristles 36 of the head 32, any dust that is not drawn into the apertures 38 of the head 32 will instead be drawn in through the extension apertures 30. As such, a user does not need to focus great attention on where the head 32 is placed relative to a dusty surface when cleaning, as both the apertures 38 and extension apertures 30 draw in and collect the dust.

It must be further emphasized that the head component 32 of the device 10 is capable of size, length, and various other modifications in order to provide the most effective dust collecting means. As such the prior descriptions and depictions of the head component 32 were shown merely as the simplest descriptive means and therefor should not be considered limiting in any manner. However, in aiding to portray the overall scope and intent of the invention, an additional preferred mode of the head component 32 is described immediately below.

FIGS. 5-6, show views of another preferred mode of the head component 32 of the device 10. As can be seen, the tube 34 includes at least on articulating portion 35 providing a means to articulate, or otherwise bend, the bristle end 36 of the head 32 as needed to reach hard to reach places, such as between small spaces. The articulating portion 35 may be a mechanical hinge or forming the tube 34 of malleable material to accommodate a living hinge, or other means suitable for the intended purpose.

The foregoing exemplary descriptions and the illustrative preferred embodiments of the present invention have been explained in the drawings and described in detail with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A cleaning device for cleaning and collecting dust and other small debris comprising:

a housing, said housing having an engagement end having an aperture formed therein;

said housing having a second end having an opening formed therein;

a passage communicating between said aperture, and said opening at said second end of said housing;

an extension member having a first end and a distal end and having a conduit communicating between said distal end and said first end;

means for engagement of said first end of said extension member with said second end of said housing;

said engagement end of said housing configured for an engagement with a vacuum source;

a dusting head having a mounting member in an engagement with said distal end of said extension member;

one or a plurality of said apertures in a substantially sealed communication with said conduit, said one or a plurality of apertures positioned upon one or both of said mounting member or said distal end of said extension member;

said vacuum source in said engagement with said engagement end of said housing, providing means to draw a fluid flow through said one or a plurality of said apertures, from a position adjacent to said distal end of said extension member toward said vacuum source; and said fluid flow providing means for engaging and communicating said dust and small debris from said surface for a deposit thereof to a reservoir via said fluid stream and a collar located between said aperture and said extension member;

and allowing a continuous passage of air between said collar, said aperture, and said extension member;

and connected to said extension member said collar being narrower on the end of the collar connected to said extension member than it is on the end of the collar closer to said apertures.

2. The cleaning device of claim 1 additionally comprising:

said extension member being telescopic and translatable between a collapsed shortest length to an extended longest length, and whereby a translation of said extension member provides means for positioning of said dusting head closer to or further from second end of said housing.

3. The cleaning device of claim 2 additionally comprising:

said engagement of said mounting member with said distal end of said extension member being a removable engagement; and said dusting head being replaceable with a replacement dusting head from a plurality of said dusting heads;

said plurality of dusting heads having bristles extending therefrom where said bristles are each extended at angles of 90 degrees relative to the dusting heads they extend from; and some of said plurality of dusting heads having a said aperture located upon a respective mounting member thereof.

4. The cleaning device of claim 3 additionally comprising:

said engagement of said mounting member with said distal end of said extension member being engaged to a means for rotation; and said means for rotation being powered by said fluid flow to impart a rotation to said dusting head.

5. The cleaning device of claim 2 additionally comprising:

said engagement of said mounting member with said distal end of said extension member being engaged to a means for rotation; and said means for rotation being powered by said fluid flow to impart a rotation to said dusting head.

6. The cleaning device of claim 2 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

7. The cleaning device of claim 1 additionally comprising:

said engagement of said mounting member of said distal end of said extension member being a removable engagement; and said dusting head being replaceable with a replacement dusting head from a plurality of said dusting heads;

said plurality of said dusting heads having bristles extending therefrom where said bristles are each extended at angles of 90 degrees relative to the dusting heads they extend from; and some of said plurality of said dusting heads having a said aperture located upon a respective mounting member thereof.

8. The cleaning device of claim 7 additionally comprising:

said engagement of said mounting member with said distal end of said extension member being engaged to a means for rotation; and said means for rotation being powered by said fluid flow to impart a rotation to said dusting head.

9. The cleaning device of claim 8 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

10. The cleaning device of claim 7 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

11. The cleaning device of claim 1 additionally comprising:

said engagement of said mounting member with said distal end of said extension member being engaged to a means for rotation; and said means for rotation powered by said fluid flow to impart a rotation to said dusting head.

12. The cleaning device of claim 11 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

13. A cleaning device for cleaning and collecting dust and other small debris comprising:

a housing, said housing having an engagement end having an aperture formed therein;

said housing having a second end having an opening formed therein;

a passage communicating between said aperture, and said opening at said second end of said housing;

an extension member having a first end and a distal end and having a conduit communicating between said distal end and said first end;

means for engagement of said first end of said extension member with said second end of said housing;

said engagement end of said housing configured for an engagement with a vacuum source;

a dusting head having a mounting member in an engagement with said distal end of said extension member;

one or a plurality of said apertures in a substantially sealed communication with said conduit, said one or a plurality of apertures positioned upon one or both of said mounting member or said distal end of said extension member;

said vacuum source in said engagement with said engagement end of said housing, providing means to draw a fluid flow through said one or a plurality of said apertures, from a position adjacent to said distal end of said extension member toward said vacuum source; and said fluid flow providing means for engaging and communicating said dust and small debris from said surface for a deposit thereof to a reservoir via said fluid stream and a collar located between said aperture and said extension member;

and allowing a continuous passage of air between said collar, said aperture, and said extension member;

and connected to said extension member said collar being narrower on the end of the collar connected to said extension member than it is on the end of the collar closer to said apertures and said means for engagement of said first end of said extension member with said second end of said housing being removably engageable to allow a replacement of said extension member; and said extension member being one from a plurality of said extension members, said plurality having said extension members in differing lengths, whereby replacement of said extension member provides means for positioning of said dusting head closer to or further from said second end of said housing.

14. The cleaning device of claim 13 additionally comprising:

said engagement of said mounting member with said distal end of said extension member being a removable engagement; and said dusting head being replaceable with being replaceable with a replacement dusting head from a plurality of said dusting heads;

said plurality of dusting heads having bristles extending therefrom where said bristles are each extended at angles of 90 degrees relative to the dusting heads they extend from; and some of said plurality of said dusting heads having a said aperture located on a respective mounting member thereof.

15. The cleaning device of claim 14 additionally comprising:

said engagement of said mounting member with said distal end of said extension member being engaged to a means for rotation; and said means for rotation being powered by said fluid flow to impart a rotation to said dusting head.

16. The cleaning device of claim 14 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

17. The cleaning device of claim 13 additionally comprising;

said engagement of said mounting member with said distal end of said extension member being engaged to a means for rotation; and said means for rotation powered by said fluid flow to impart a rotation to said dusting head.

18. The cleaning device of claim 17 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

19. The cleaning device of claim 13 additionally comprising:

a portable aperture having an intake housing on the first end communicating with a vacuum source housed in said portable housing;

means for communicating electrical power to power said vacuum source in said portable housing;

said first end of said portable housing having an exterior circumference of substantially 1.25 inches; and said engagement end of said housing removably engageable with both said first end of said portable housing and a conventional vacuum clear hose having distal end with a circumference of substantially 1.25 inches.

20. A cleaning device for cleaning and collecting dust and other small debris comprising:

a housing, said housing having an engagement end having an aperture formed therein;

said housing having a second end having an opening formed therein;

a passage communicating between said aperture, and said opening at said second end of said housing;

an extension member having a first end and a distal end and having a conduit communicating between said distal end and said first end;

means for engagement of said first end of said extension member with said second end of said housing;

said engagement end of said housing configured for an engagement with a vacuum source;

a dusting head having a mounting member in an engagement with said distal end of said extension member;

one or a plurality of said apertures in a substantially sealed communication with said conduit, said one or a plurality of apertures positioned upon one or both of said mounting member or said distal end of said extension member;

said vacuum source in said engagement with said engagement end of said housing, providing means to draw a fluid flow through said one or a plurality of said apertures, from a position adjacent to said distal end of said extension member toward said vacuum source; and said fluid flow providing means for engaging and communicating said dust and small debris from said surface for a deposit thereof to a reservoir via said fluid stream and a collar located between said aperture and said extension member;

and allowing a continuous passage of air between said collar, said aperture, and said extension member;

and connected to said extension member said collar being narrower on the end of the collar connected to said extension member than it is on the end of the collar closer to said apertures and a portable housing having an intake aperture at a first end communicating with a vacuum storage housed in said portable housing;

said first end of said portable housing having an exterior circumference of substantially 1.25 inches; and said engagement end of said housing removably engageable with both said first end of said portable housing and a conventional vacuum cleaner hose having distal end with a circumference of substantially 1.25 inches.

* * * * *